US006948566B2

(12) United States Patent
Sundholm

(10) Patent No.: US 6,948,566 B2
(45) Date of Patent: Sep. 27, 2005

(54) SPRAYING APPARATUS

(75) Inventor: Göran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 0 days.

(21) Appl. No.: 10/485,802

(22) PCT Filed: Sep. 10, 2002

(86) PCT No.: PCT/FI02/00727

§ 371 (c)(1),
(2), (4) Date: Jun. 9, 2004

(87) PCT Pub. No.: WO03/024535

PCT Pub. Date: Mar. 27, 2003

(65) Prior Publication Data

US 2004/0216897 A1 Nov. 4, 2004

(30) Foreign Application Priority Data

Sep. 19, 2001 (FI) ..... 20011841

(51) Int. Cl.[7] ..... A62C 37/08; B05B 15/06

(52) U.S. Cl. ..... 169/37; 239/200; 239/207; 239/288.3

(58) Field of Search ..... 239/200, 201, 239/203, 204, 205, 288, 288.3, 288.5, 207, 208; 169/62, 37, 16; 2539/207, 208

(56) References Cited

U.S. PATENT DOCUMENTS

| | | | | | |
|---|---|---|---|---|---|
| 1,837,322 | A | | 12/1931 | Hamilton | |
| 2,059,190 | A | * | 11/1936 | Allen | 169/11 |
| 5,501,282 | A | * | 3/1996 | Sundholm | 169/37 |
| 6,047,897 | A | * | 4/2000 | Ueno et al. | 239/1 |
| 6,182,767 | B1 | * | 2/2001 | Jackson | 169/16 |
| 6,371,212 | B1 | | 4/2002 | Jackson | |

FOREIGN PATENT DOCUMENTS

| | | |
|---|---|---|
| WO | 9300962 | 1/1993 |

* cited by examiner

*Primary Examiner*—David A. Scherbel
*Assistant Examiner*—Seth Barney
(74) *Attorney, Agent, or Firm*—Ladas & Parry

(57) ABSTRACT

Spraying apparatus, designed especially for fire-fighting purposes, at least one spray head (1) and one holder (2), in which the spray head can be moved between at least two positions, the spray head being in a retracted position when in an inactive state, and when it is in an active state, at least one of the nozzles of the spray head extends beyond edges of the holder. The spray head (1) is in a surface-mounted structural part (7) having at least one spray head holder (2) and a supply (8) for supplying a medium, such as an extinguishing medium, to be sprayed from the spray head.

20 Claims, 2 Drawing Sheets

SPRAYING APPARATUS

BACKGROUND OF THE INVENTION

The present invention relates to a spraying apparatus designed especially for fire-fighting, said apparatus comprising at least one spray head and a holder in which the spray head can be moved between at least two positions, the spray head being in a retracted position when in an inactive state while in an active state at least one of the nozzles of the spray head is above the edges of the holder.

Specification EP 594717 discloses a fire-fighting apparatus employing spray heads that are mounted in the floor and spring up when activated. These have proved to be very effective and functional. EP 594717 comprises a spray head holder embedded in a floor. Also U.S. Pat. No. 1,837,322 and U.S. Pat. No. 6,182,767 show at least partly embedded spray head structures.

However, there has arisen a need to develop these spray heads further and achieve a spraying apparatus that is better suited for use especially as a retrofit, designed especially for fire-fighting. Another object of the invention is to achieve a spray head whose nozzles, which may be arranged in an asymmetric manner, can be directed and held directed in a desired radial direction.

BRIEF DESCRIPTIONS OF THE INVENTION

The invention is based on an idea according to which the spray heads are disposed in a surface-mounted structural part that also provides a space for the required pipes for a fire-fighting medium.

The apparatus of the invention is mainly characterized in that the spray head is disposed in a surface-mounted structural part, which comprises at least one spray head holder and means for supplying a medium to be sprayed, such as an extinguishing medium, to the spray head.

The system of the invention has many significant advantages. Disposing the spray heads in a surface-mounted structural part makes it considerably easier to install spraying equipment, such as e.g. fire-fighting systems mounted in the floor, and allows the system to be installed on finished floor, wall and ceiling surfaces without embedded structures. By providing the structural part with at least one surface extending obliquely outward from the mounting plane, it will be possible to install a floor-mounted device on a passageway, so that vehicles can pass over it. The solution of the invention is suited for Installation in a wide variety of places. Typical places of installation are e.g. the floors of spaces intended for the storage, maintenance and testing of aircraft, such as hangars.

SHORT DESCRIPTION OF ILLUSTRATIONS

Figure 2:
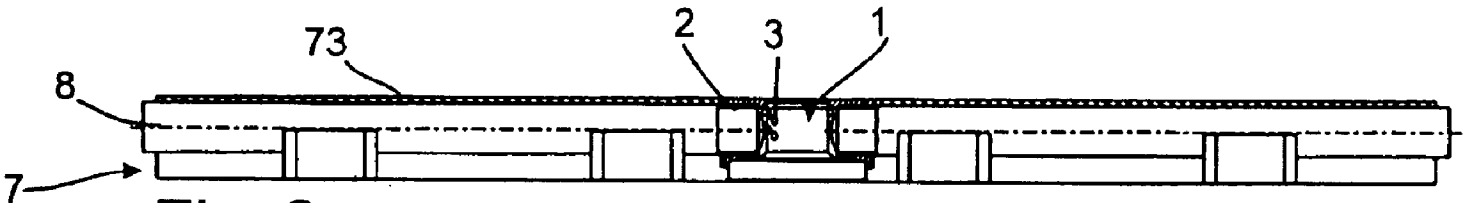
Figure 1:
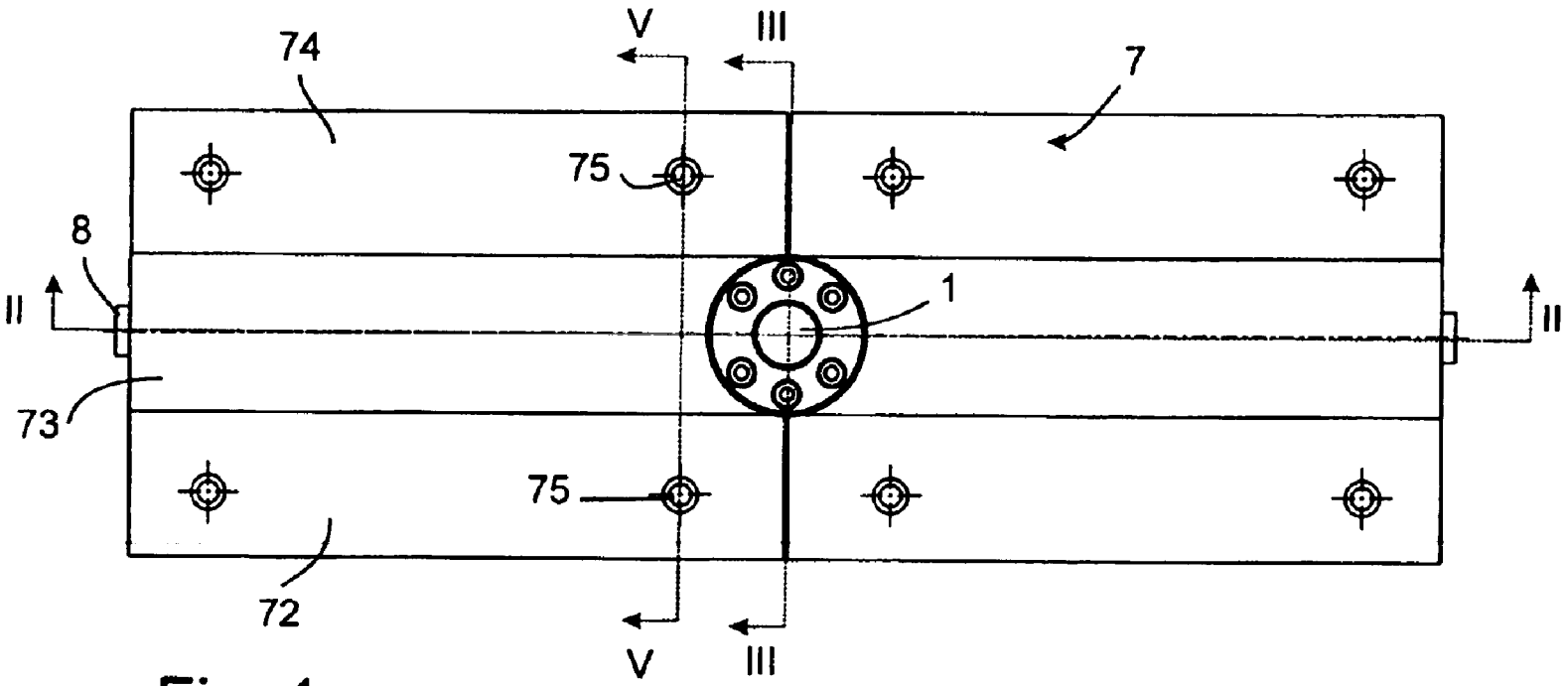
Figure 3:
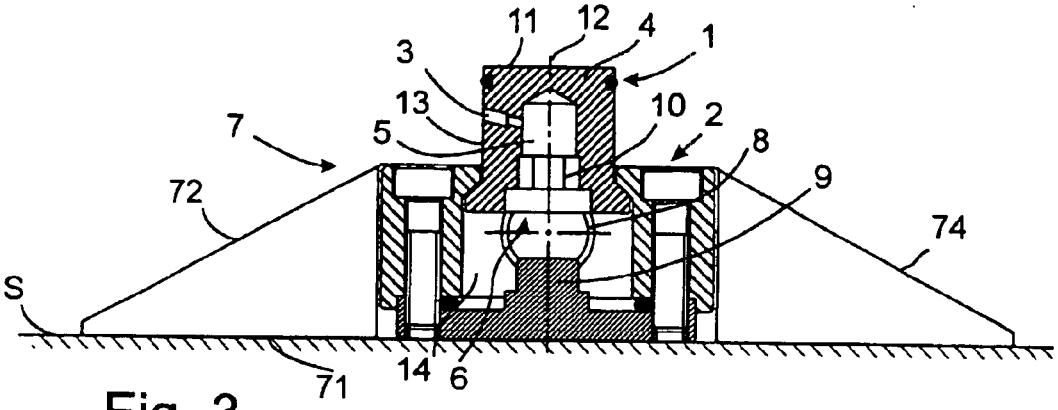
Figure 4:
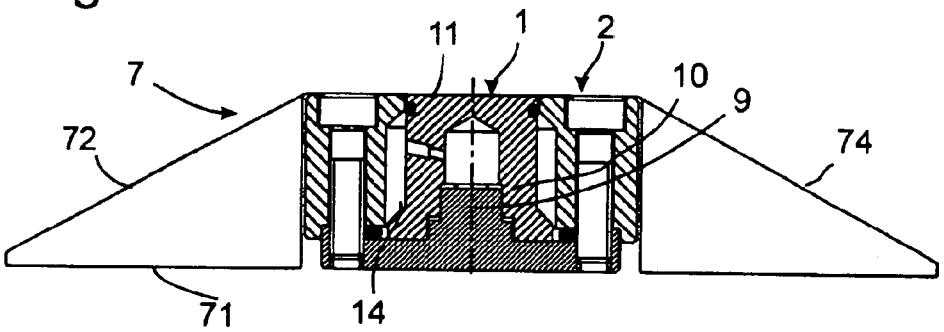
Figure 5:
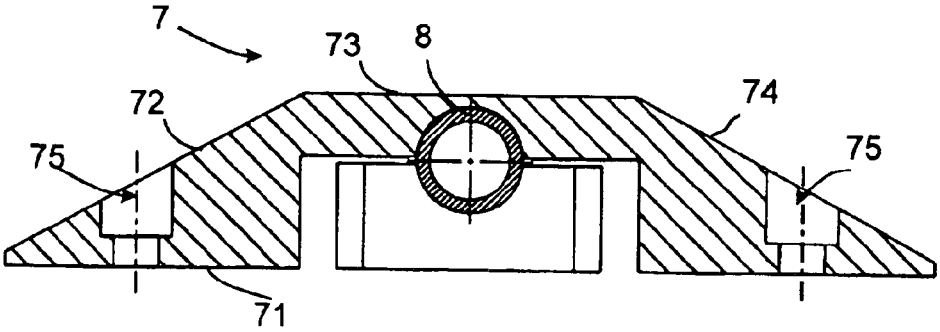

In the following, the invention will be described in detail by the aid of an example with reference to the attached drawing, wherein FIG. 1 presents an apparatus according to the invention in top view, FIG. 2 presents the apparatus of the invention, sectioned along line II—II in FIG. 1, FIG. 3 presents the apparatus of the invention, sectioned along line III—III in FIG. 1, with the spray head in an activated state, FIG. 4 presents the apparatus of FIG. 3 with the spray head in a non-activated state, and FIG. 5 presents the apparatus of the Invention, sectioned along line V—V in FIG. 1.

DETAILED DESCRIPTION OF THE INVENTION

The figures present a spraying apparatus according to the invention. The apparatus comprises a spray head 1, which is mounted in a holder 2 so as to be movable between at least two positions. The holder 2 again is placed in a structural part 7. The holder 2 may be integrated with the structural part 7 or it may be a part attached to it with fastening elements. The structural part 7 of the apparatus is provided with at least one spray head 1 and means 8, such as a tube element, for supplying a spraying medium, e.g. a liquid or a mixture of a liquid and a gas, preferably an extinguishing medium, to the spray head 1. The spray head 1 comprises at least one nozzle 3, disposed in the frame part 4 of the spray head. The frame part 4 is provided with at least one channel part 5, into which the extinguishing medium is passed via a supply orifice 6. The extinguishing medium is passed into the chamber space of the holder 2 via a tube element 8. The spray head is switched from a non-activated state into an activated state by the action of the pressure of the spraying medium, e.g. as a result of a triggering of the fire-fighting system. This basic function of the spray head is in Itself known e.g. from specification EP 594717 and it will not be described here in detail. The spray head of an embodiment of the invention is very well suited for spraying a medium under high pressure. The pressure in the piping is typically over 30 bar, preferably over 50 bar, most preferably over 75 bar.

The spraying apparatus of the invention, especially for fire-fighting purposes, thus comprises at least one spray head 1 and a holder 2, in which the spray head can be moved between at least two positions, the spray head being in a retracted position when in the non-active state while in the active state at least one 3 of the nozzles of the spray head is above the edges of the holder. The apparatus has a base part 7, preferably a structural part, which is mounted on the surface S, and in its retracted position (or in both positions) the spray head does not extend below the base part (or intersect the plane of the base). The spray head 1 is placed in the base part 7, which comprises at least one spray head holder 2 and a connecting element 8 for the supply of extinguishing medium into the spray head. The holder 2 comprises a chamber space 14, in which the spray head is movable. In FIG. 3, the spray head is shown in an active position and in FIG. 4 in a non-active position.

At least one wall 72 of the structural part 7 extending outward from the mounting surface 71 is sloping. The at least one wall 72 forms a certain proportion of the vertical height of the structural part and is inclined at an angle, typically between 10–60 degrees, with respect to the mounting surface. This makes the apparatus of the invention well applicable for use in spaces where vehicles run over it. The sloping edge parts 72, 72 allow a vehicle to pass easily over the spraying module of the invention. The solution of the invention, in which the tube 8 for an extinguishing medium is laid substantially horizontally in the structural part and connected to the spray head holder 2 from a lateral direction, allows the apparatus to be implemented as a very low and compact structure. The sectioned view in FIG. 5 presents a preferred cross-section of the structural part according to the invention. The structural part 7 Is fixed to a base, such as a floor, using fastening elements, via holes 75 formed In the structural part.

The holder 2 disposed in the structural part is provided with at least one guide element 9, and the spray head 1 is provided with at least one counterface 10 matching the guide element to keep the spray head in a desired orientation, at least in the non-activated position. The guide element 9 and at least one counterface 10 of the spray head are designed to be mutually fitting in several different positions of the spray head 1 so that the nozzle can be directed in a desired radial direction. At least one guide element 9 is disposed symmetrically relative to the center axis 12 of the spray head 1. The cross-section of the guide element 9 in a plane perpendicular to the center axis 12 is a polygon. Thus, when the guide element 9 has a triangular cross-section and the counterfaces 10 have a shape corresponding to the guide element, the spray head can be directed in at least three radial directions relative to the center axis 12, preferably in steps of 120 degrees. Similarly, when a hexagonal cross-sectional surface is used, the spray head can be directed in at least six different directions, preferably in steps of 60 degrees. Other appropriate shapes may also be used. Alternatively, the guide element could consist of e.g. a toothing formed in the lower part of the spray head and fitting to a counter-toothing formed in the holder. It is obvious to a person skilled in the art that the guide element and the counterface may be interchangeable, i.e. the guide element may be part of the spray head and the counterface correspondingly provided in the holder.

In the non-activated position, the upper surface 11 of the spray head 1 is substantially flush with the upper surface 73 of the structural part. Thus, the upper surface of the structural part 7 and the upper surface 11 of the spray head form a substantially even and continuous surface, which forms no obstacle to the movement of vehicles and is also easy to keep clean. The nozzles 3 of the spray head are preferably located on a lateral surface 13 of the spray head, being thus protected against possible fouling when in the non-active state.

The apparatus of the invention typically comprises a number of modules comprising at least one spray head and one structural part, said modules being preferably designed to be connected together in tandem.

It is obvious to the person skilled in the art that the invention is not limited to the embodiments described above, but it they may be varied within the scope of the following claims.

What is claimed is:

1. Spraying apparatus, comprising at least one spray head (1) having at least one nozzle, a holder (2) in which the spray head can be moved between a retracted position when in an inactive state and another position with the at least one nozzle beyond the edges of the holder when in an active state, and a surface-mounted structural part (7) comprising the holder (2) and means (8) for supplying a medium to be sprayed to the spray head.

2. Apparatus according to claim 1, characterized in that at least one wall (72, 74) of the structural part (7) extends obliquely outward from the mounting surface (71).

3. Apparatus according to claim 1, characterized in that the holder (2) is provided with at least one guide element (9) and the spray head with at least one counterface (10) matching the guide element to keep the spray head in a desired orientation, at least in the non-activated position.

4. Apparatus according to claim 1, characterized by at least one guide element (9) disposed in the holder and at least one counterface (10) of the spray head are designed to be mutually fitting in several different positions of the spray head so that the (3) nozzle can be directed in a desired radial direction.

5. Apparatus according to claim 1, characterized in that a guide element (9) is disposed symmetrically relative to a center axis (12) of spray head.

6. Apparatus according to claim 1, characterized in that a cross section of a guide element (9) is a polygon.

7. Apparatus according to claim 1, characterized in that the upper surface (11) of the spray head (1) in the inactive position is substantially flush with the upper surface (73) of the structural part (7).

8. Apparatus according to claim 1, characterized in that the apparatus comprises a number of modules comprising a spray head (1) and a structural part (7), said modules being preferably designed to be connected together in tandem.

9. Apparatus according to claim 2, characterized in that the holder (2) is provided with at least one guide element (9) and the spray head with at least one counterface (10) matching the guide element to keep the spray head in a desired orientation, at least in the non-activated position.

10. Apparatus according to claim 2, characterized by at least one guide element (9) disposed in the holder and at least one counterface (10) of the spray head are designed to be mutually fitting in several different positions of the spray head so that the (3) nozzle can be directed in a desired radial direction.

11. Apparatus according to claim 3, characterized by at least one guide element (9) disposed in the holder and at least one counterface (10) of the spray head are designed to be mutually fitting in several different positions of the spray head so that the (3) nozzle can be directed in a desired radial direction.

12. Apparatus according to claim 9, characterized by at least one guide element (9) disposed in the holder and at least one counterface (10) of the spray head are designed to be mutually fitting in several different positions of the spray head so that the (3) nozzle can be directed in a desired radial direction.

13. Apparatus according to claim 2, characterized in that a guide element (9) is disposed symmetrically relative to a center axis (12) of the spray head.

14. Apparatus according to claim 3, characterized in that the guide element (9) is disposed symmetrically relative to a center axis (12) of the spray head.

15. Apparatus according to claim 4, characterized in that the guide element (9) is disposed symmetrically relative to a center axis (12) of the spray head.

16. Apparatus according to claim 9, characterized in that the guide element (9) is disposed symmetrically relative to a center axis (12) of the spray head.

17. Apparatus according to claim 10, characterized in that the guide element (9) is disposed symmetrically relative to a center axis (12) of the spray head.

18. Apparatus according to claim 2, characterized in that a cross section of guide element (9) is a polygon.

19. Apparatus according to claim 3, characterized in that a cross section of the guide element (9) is a polygon.

20. Apparatus according to claim 4, characterized in that a cross section of the guide element (9) is a polygon.

* * * * *